United States Patent [19]

Kaman, II

[11] 4,172,405

[45] Oct. 30, 1979

[54] STRINGED INSTRUMENT CONSTRUCTION

[75] Inventor: Charles W. Kaman, II, East Killingly, Conn.

[73] Assignee: Kaman Aerospace Corporation, Bloomfield, Conn.

[21] Appl. No.: 844,875

[22] Filed: Oct. 25, 1977

[51] Int. Cl.[2] ..... G10D 3/00

[52] U.S. Cl. ..... 84/293

[58] Field of Search ..... 84/293, 291, 290, 267, 84/292

[56] References Cited

U.S. PATENT DOCUMENTS

| | | | |
|---|---|---|---|
| 1,881,229 | 10/1932 | Young | 84/291 |
| 2,056,474 | 10/1936 | Low | 84/293 |
| 2,100,249 | 11/1937 | Hart | 84/293 |
| 2,497,116 | 2/1950 | Dopyera | 84/293 |
| 3,974,730 | 8/1976 | Adams | 84/291 |
| 4,084,476 | 4/1978 | Richard | 84/293 |

*Primary Examiner*—L. T. Hix
*Assistant Examiner*—S. D. Schreyer
*Attorney, Agent, or Firm*—McCormick, Paulding & Huber

[57] ABSTRACT

A stringed instrument, such as a guitar, with a neck and a body, is constructed to provide a stiffened neck adjustable to compensate for bending due to string forces and also to provide a sound, easily made connection, between the neck and the body. The neck is an assembly including a metallic stiffener embeded in a main neck part and carrying a tension rod. A nut on one end of the rod tensions the rod to control bending of the stiffener and of the remainder of the neck which is fixed to it. At its lower end the stiffener includes a rearwardly extending heel through which the neck is firmly connected to the body.

7 Claims, 10 Drawing Figures

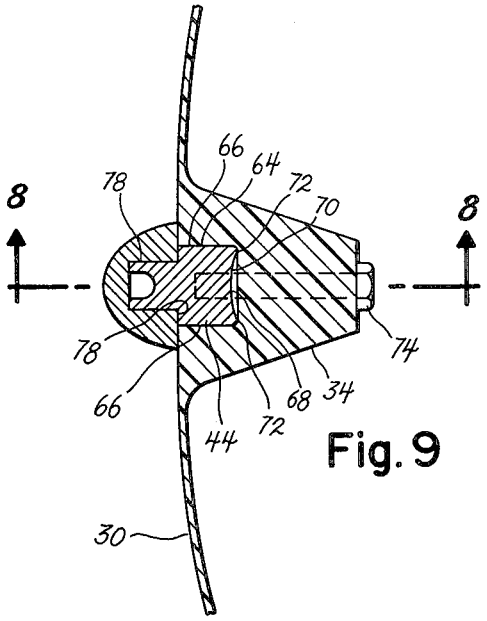
Fig. 9
Fig. 10
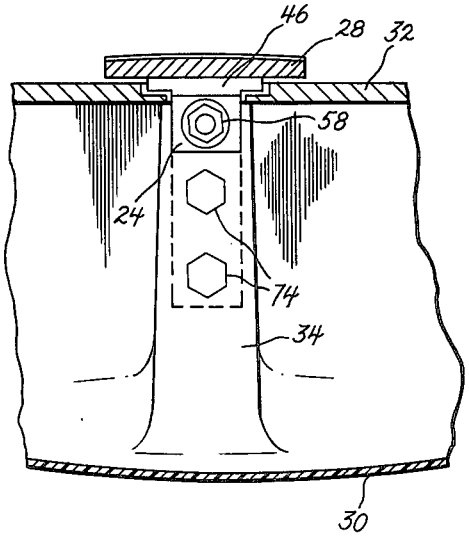

STRINGED INSTRUMENT CONSTRUCTION

BACKGROUND OF THE INVENTION

This invention relates to stringed muscial instruments of the kind having a body and a neck, and deals more particularly with an improved construction of the neck of such an instrument and of the means for connecting the neck to the instrument body.

In the case of guitars, mandolins, banjos, basses, violins and similar instruments having necks and bodies, it is well-known that the force of the strings acting on the outer end of the neck tends to bend or warp the neck and thereby affects the spacing between the strings and the fingerboard, and various different expedients have been proposed in the past to compensate for or to counteract such bending. Some proposals involve making the neck of metal or other relatively stiff material so to minimize the bending influence of the string forces. These constructions are, however, usually relatively heavy and do not include any means for correcting whatever bending does occur. Other proposals involve the use of a tension rod in the neck which compressively loads the neck in such a way as to bend it in opposition to the bending influence of the strings. A common disadvantage of prior tension rod systems is, however, that the wood of the neck with which the tension rod cooperates is relatively compressible so that the nut on the tension rod has to be turned through a relatively large angle to produce an appreciable change in the bending of the neck. That is, the neck bending is relatively insensitive to the rotation of the adjustment nut and the range of bending available through adjustment of the nut is limited and very often not sufficient to meet the demand.

The connection between the neck and the body is also important since any weakness in this area will allow bending of the body relative to the neck, and this also affects the spacing of the strings relative to the fingerboard. A quality guitar, therefore, requires a sound, rigid and unyielding connection between the neck and the body.

Thus, the general object of this invention is to provide an instrument construction whereby the neck has a sturdy solid feel and is adjustable to counteract a wide range of bending influences imposed thereon. In particular, the object is to provide a guitar neck having a tension rod system wherein the neck is highly sensitive and responsive to changes in the angular position of the adjusting nut so that only a small rotation of the nut is required to produce an appreciable change in the bend of the neck and whereby the range of neck bending effected by adjustment of the nut is quite large so as to be able to counteract a similarly large range of natural bending influences.

A further object of this invention is to provide a neck construction of the foregoing character which also cooperates with the body of the instrument to provide a simply made yet sound unyielding connection between the body and the neck.

Other objects and advantages of the invention will become apparent from the accompanying drawings and from the following detailed description of a preferred embodiment.

SUMMARY OF THE INVENTION

This invention resides in a stringed musical instrument having a body and a neck with the neck being an assembly of parts including a main part, a stiffener, a tension rod and a fingerboard. The main part of the neck has a forwardly opening longitudinal groove which receives an elongated portion of the stiffener and which is overlaid by the fingerboard so as to hide the stiffener from view. The elongated portion of the stiffener along all or substantially all of its length common to the main part is fixed by adhesive or other means to the main part so that as the stiffener bends the main part and the fingerboard is bent along with it. The stiffener has a longitudinally extending recess which receives the tension rod, the tension rod at one end including an adjustment screw for tensioning the rod between abutment surfaces on opposite ends of the stiffener. The tension rod and stiffener are both made of metal or other relatively high modulus of elasticity material so that as the effective length of the tension is changed by rotation of its associated nut the stiffener will accommodate the rod length change by bending with very little compressive change in its own length. The invention also resides in the stiffener having a rearwardly extending heel as its lower end which receives at least one threaded fastener for clamping the body of the instrument to the neck to provide a firm connection between the two.

The invention also resides in other details of the connection between the neck and the body and in details of construction of the stiffener and tension rod.

BRIEF DESCRIPTION OF THE DRAWINGS

FIG. 9 is a horizontal view taken on the line 9—9 of FIG. 8.

FIG. 10 is a vertical sectional view taken on the line 10—10 of FIG. 8.

DETAILED DESCRIPTION OF THE PREFERRED EMBODIMENT

As used herein, and in the claims which follow, the relative terms "upper", "lower", "forward", and "rear", and their derivatives, are used with the instrument in question assumed to be oriented with its peg head uppermost and with its soundboard facing the viewer.

Figure 1:
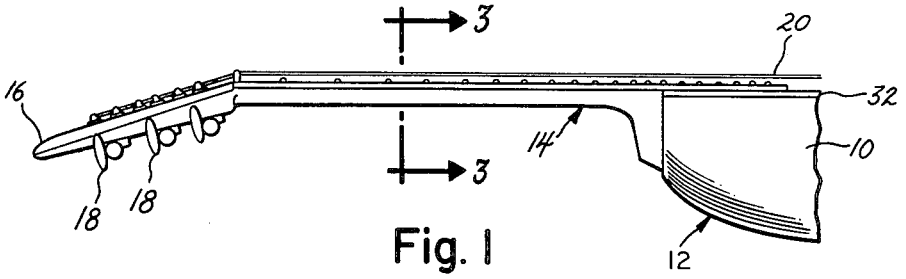
FIG. 1 is a fragmentary side view of a guitar embodying the present invention.
Figure 3:
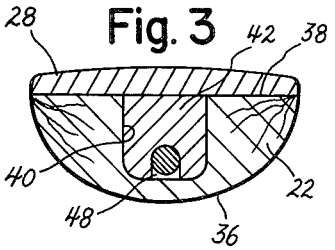
FIG. 3 is a vertical sectional view taken on the line 3—3 of FIG. 1.

Turning to FIG. 1, a guitar 10 embodying the invention is there shown and is broadly of a generally conventional character insofar as it includes a hollow body 12 and a neck 14 extending upwardly from the upper end of the body. At its upper end the neck 14 has a peg head 16 carrying a number of machines 18, 18 each associated with one of the strings 20, 20. Each string at its upper end is attached to its associated machine 18 and at its lower end is attached to a suitable bridge or tailpiece (not shown).

Figure 2:
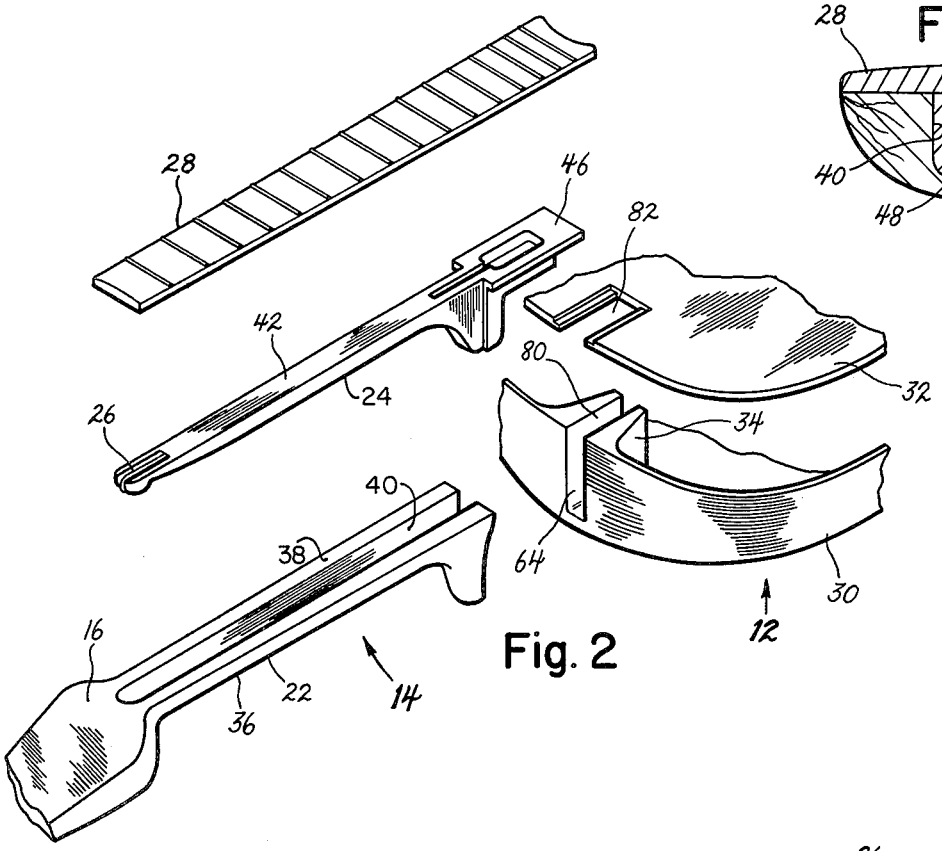
FIG. 2 is an exploded view of the portion of the guitar shown in FIG. 1.

The invention resides in the construction of the neck 14 and in its means of attachment to the body 12. As to this, and as shown in FIG. 2, the neck 14 is an assembly of parts including a main neck part 22, a stiffener 24 a tension rod 26 and a fretted fingerboard 28. The body 12 includes a bowl 30 and a soundboard 32. The bowl 30, preferably and as shown, is a one piece unit made of a molded material such as a plastic or a composite material consisting of fiberglass or other fibers embedded in a resin matrix. The bowl 30 is relatively thin walled throughout its entire extent except that at the location of its connection to the neck 14 it includes a relatively massive block 34 of the bowl material formed integral with the adjacent thin walls of the bowl. The soundboard or top 32 may be made of wood or other suitable material such as the graphite and wood sandwich shown in U.S. Pat. No. 3,880,040, and it is attached along its periphery to the forwardly facing edge of the bowl 30 by adhesive or other suitable means.

Between the peg head 16 and its lower end, the main neck part 22 has a rounded rear surface 36 and a flat forward surface 38. A longitudinally extending groove 40, opening forwardly onto the forward surface 38, receives a conforming elongated portion 42 of the stiffener 24. The fingerboard 28 is glued or otherwise fixed to the forward surface 38 of the neck part 22 so as to overlie the stiffener and hide it from view. Along their common length the stiffener portion 42 is fixed to the main neck part 22. This fixing may be achieved in various different ways depending on the material of the neck part and stiffener. In the illustrated case, the neck part 22 is made of wood and its fixing to the stiffener is obtained through the use of a suitable adhesive between the two. On the other hand, the neck part 22 may, in an alternative construction, be made, for example, of a structural foamed plastic foamed in place around the stiffener 24 and the fixing of the stiffener to the neck part may be achieved merely by roughening the surface of the stiffener prior to the foaming of the neck part to produce a mechanical interlocking of the neck part material with the stiffener material.

Figure 4:
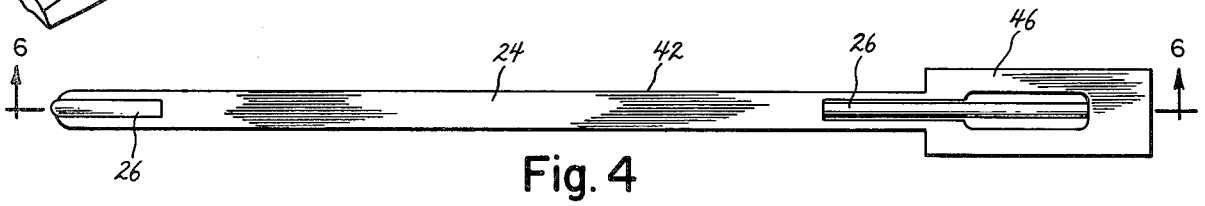
FIG. 4 is a top view of the stiffener and tension rod used in the neck of the guitar in FIG. 1.
Figure 5:
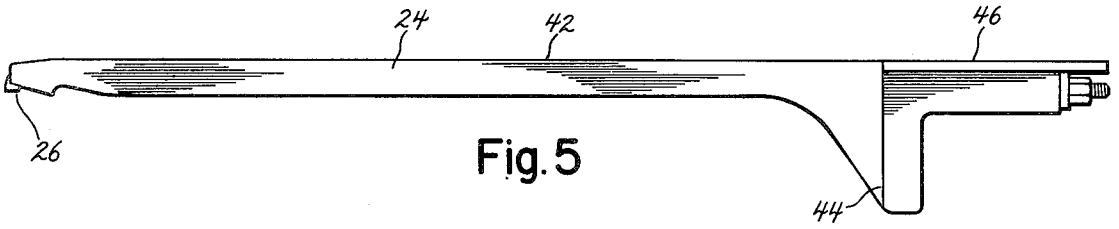
FIG. 5 is a side view of the stiffener and tension rod of FIG. 4.
Figure 6:
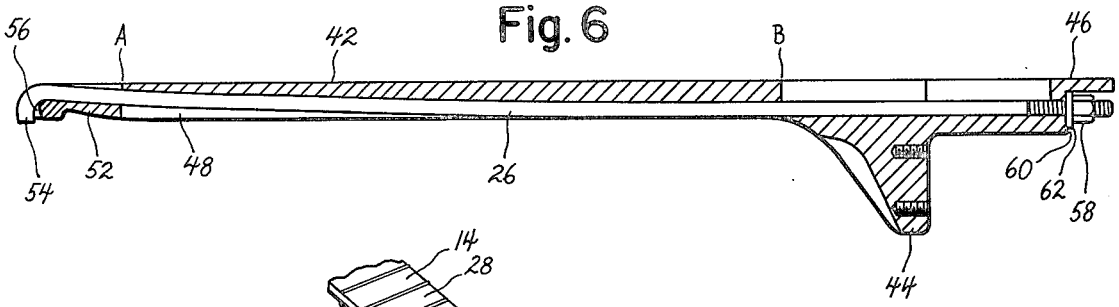
FIG. 6 is a vertical longitudinal sectional view taken on the line 6—6 of FIG. 4 with the tension rod being shown in elevation.
Figure 7:
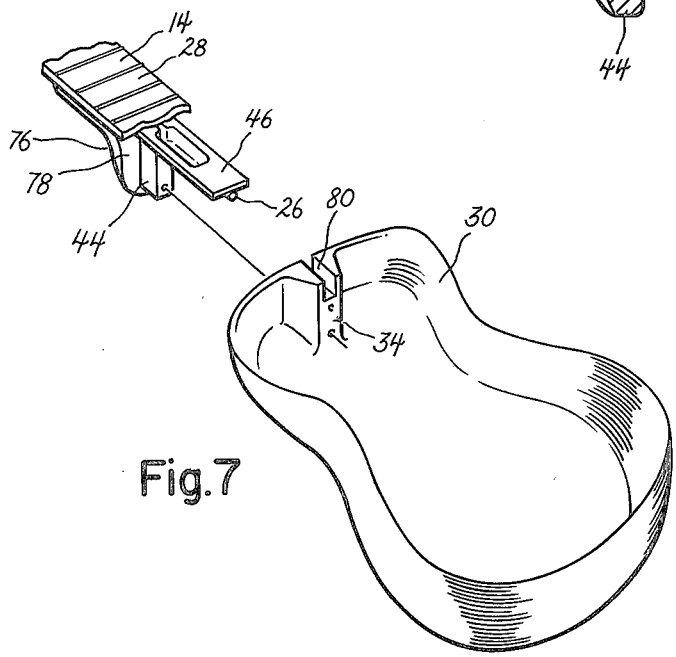
FIG. 7 is an exploded perspective view showing the relationship between the neck and body bowl of the guitar of FIG. 1, a portion of the fingerboard being shown broken away to reveal other neck details.
Figure 8:
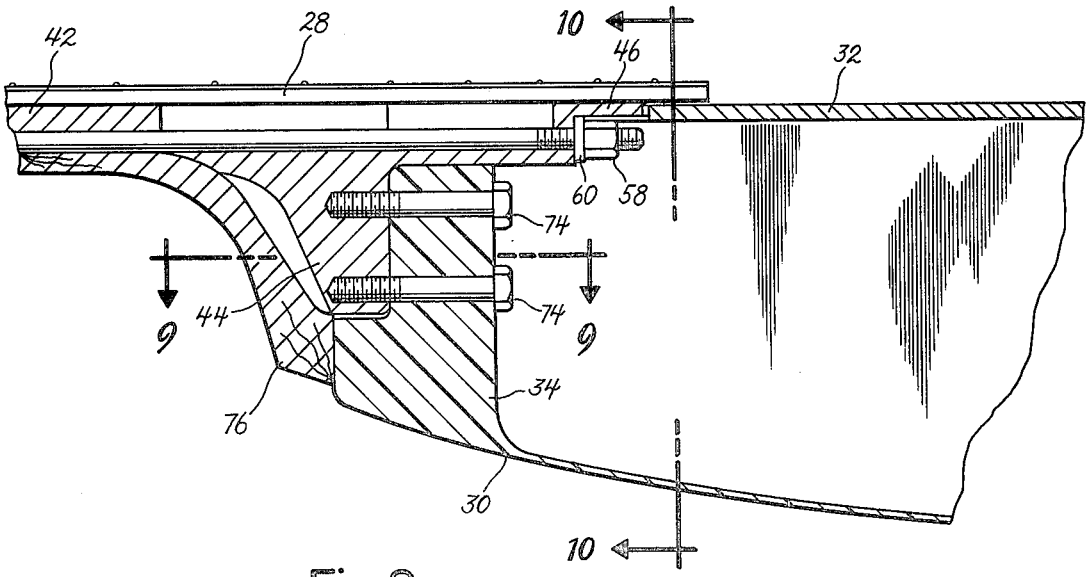
FIG. 8 is a fragmentary vertical longitudinal sectional view taken on the line 8—8 of FIG. 9, through the connection between the neck and the body of the guitar of FIG. 1.

The structure of the stiffener 24 and of its associated tension rod 26 is shown in detail in FIGS. 4, 5 and 6. Referring to these figures, the stiffener includes the elongated portion 42 and also includes, near the lower end of the elongated portion 42, a rearwardly extending heel portion 44 and a broadened forward portion 46. Along its length, the elongated portion 42 includes a recess 48 for receiving the tension rod 26. Between the points marked A and B in FIG. 6, the recess 48 is in the form of a rearwardly opening groove and has a convex root surface 50 against which the tension rod 26 bears. Upwardly (leftwardly in FIG. 6) of the point A the recess 48 opens forwardly and the stiffener includes material 52 located behind the tension rod 26. At its very upper end, the tension rod 26 is bent to define a stop means in the form of an end post 54 extending rearwardly perpendicular to the remainder of the tension rod and engageable with an abutment surface 56 on the stiffener to limit movement of the rod 26 relative to the stiffener in the direction toward the opposite or lower end of the rod.

The lower end of the rod 26 extends beyond the adjacent end of the elongated stiffener portion 42 and threadably receives an adjustment nut 58 which works against an adjacent abutment surface 60 on the stiffener through a washer 62. The tension rod 26 is held in a slightly bowed or bent condition by the convex surface 50 of the stiffener so that when the adjustment nut 58 is tightened to shorten the effective length of the tension rod the stiffener is bent both by the tendancy of the tension rod to straighten, thereby pushing forwardly on the convex surface 50, and by the compressive forces exerted by the tension rod on the opposite abutment surfaces 56 and 60 which cause the stiffener portion 42 to bend as a compressively loaded column.

The stiffener and tension rod are made of materials having relatively high moduli of elasticity in comparison to the material of the neck part 22 so that a given adjustment of the nut 58 will achieve a relatively high degree of bending of the stiffener in comparison to the degree of bending which would be obtained if the neck did not include the stiffener and the tension rod worked directly on the material of the neck part itself. Preferably, the stiffener is die cast and is made of a relatively light weight metal such as aluminum or magnesium. The tension rod 26 is preferably made of steel.

The details of the connection between the neck 14 and the body 12 are best shown in FIGS. 7 to 10. Referring to these figures, the bowl block 34 is shaped to define a rearwardly extending recess 64 with flat side faces 66, 66 and a flat root surface 68. The lower part of the stiffener heel portion 44 is received in this recess and has two side faces which snugly engage the side faces 66, 66 of the recess. Further, at its lower end the heel portion 44 has a convex surface 70 defining two downwardly protruding side edges 72, 72 so that the heel portion instead of flatly engaging the root surface 68 engages such surface along two areas of line contact to form a good seat between the heel portion 44 and the body block 34. Two screws 74, 74 pass through the block 34 and are threadably received by the heel portion 44. These screws have heads which bear against the interior surface of the block to compress the block between the heads of the screws and the heel portion 44 and to thereby provide a tight, firm connection between the body and the neck.

The main part 22 of the neck 14 also has a heel portion 76 with a rearwardly extending groove 78, forming a continuation of the groove 40, which receives the upper part of the stiffener heel portion 44 and which hides the stiffener from view. Further, the lower end surface 78 of the portion 76 is shaped to lie closely to the outside surface of the bowl 30 to provide a neat and finished outward appearance to the neck-body joint.

The bowl block 34 also includes a forward longitudinally extending recess 80 which receives the lower part of the stiffener elongated portion 42, thereby locating the lower end of the stiffener and the adjustment nut 58 within the interior of the body 12. Access to the adjustment nut can therefore be had by reaching into the interior of the body through the customary sound hole, but if the sound hole is too small a separate access door may be built into the body.

The main part 22 of the neck at its lower end terminates adjacent the upper end of the bowl 30, but the fingerboard continues downwardly for some distance beyond this point. This lower end portion of the fingerboard is supported by the broadened portion 46 of the stiffener which prevents the fingerboard from being bent downwardly toward the soundboard 32 when playing with the frets on that portion of the fingerboard. To accommodate the broadened portion 46 and the other adjacent portion of the stiffener, the soundboard is preferably notched as shown at 82 in FIG. 2.

Tightening the adjustment nut 58, so as to shorten the effective length of the tension rod 26, has the effect of moving the upper or peg board end of the neck rearwardly to move the strings closer to the fingerboard, whereas loosening the nut has the opposite effect of moving the upper or peg board end of the neck forwardly to increase the spacing between the strings and the fingerboard. Preferably the parts are designed so that when the instrument is initially strung some appreciable amount of tension will have to be applied to the tension rod 26, by operating the adjustment nut 58, to bring the strings into proper position relative to the fingerboard. Thus, the adjustment nut may thereafter be adjusted in either direction to move the outer end of the neck either forwardly or backwardly to compensate for any changes in the bending influences on the neck caused by the strings or other factors.

I claim:

1. In a stringed musical instrument the combination comprising: a body with upper and lower ends, and a neck extending upwardly from said upper end of said body, said neck being an assembly of parts including a main part having a forward surface and a curved rear surface and also having a groove extending longitudinally of said main part, a stiffener including an elongated portion received in said groove of said main part and fixed to said main part along substantially their entire common length, a fingerboard overlying said forward surface of said main part, said elongated portion of said stiffener having a longitudinally extending recess therein, a tension rod received in said recess, both said stiffener and said tension rod having moduli of elasticity which are relatively high in comparison to that of said main neck part, stop means at one end of said elongated stiffener portion limiting movement of the corresponding end of said tension rod in the direction toward its other end, and a nut threaded onto the other end of said tension rod and workable against the corresponding end of said elongated stiffener portion to tension said tension rod between said stop means and said nut, said stiffener including means engageable with said tension rod between said stop means and said nut to hold said tension rod in a bowed condition and to thereby cause said stiffener to be bent by a variable amount between said stop means and said nut as the effective length of said tension rod is varied by adjustment of said nut, said stiffener at the lower end of said elongated portion having a rearwardly extending heel portion, and means cooperable with said stiffener heel portion for connecting said stiffener and, through said stiffener, the remainder of said neck to said body.

2. The combination defined in claim 1 further characterized by said body being hollow and having an upper wall to which said stiffener heel portion is connected, said elongated stiffener portion and said tension rod extending downwardly through said upper wall of said body and said nut being threaded onto the lower end of said tension rod so as to be accessible from the interior of said body.

3. The combination defined in claim 1 further characterized by said body including a plastic bowl defining said upper end wall, said plastic bowl throughout the major portion of its extent being relatively thin-walled and at the location of the connection of said stiffener heel portion to said upper end wall including a relatively massive block of plastic, and at least one threaded fastener extending through said massive block of plastic and threadably engaging said stiffener heel portion, said threaded fastener having a head at its lower end so as to clamp said massive block of plastic between said head and said stiffener heel portion.

4. The combination defined in claim 3 further characterized by said upper wall of said body having a rearwardly extending upwardly opening groove in which a conforming lower part of said stiffener heel portion resides.

5. The combination defined in claim 4 further characterized by said groove in said upper wall of said body having a generally flat root surface and said heel portion of said stiffener adjacent said root surface having a generally downwardly facing convex surface to provide said heel portion with two downwardly protruding side edges which seat against said root surface of said groove.

6. The combination defined in claim 1 further characterized by said main part of said neck also having a heel portion at its lower end, said heel portion of said main neck part having a forwardly and downwardly opening recess for receiving part of said stiffener heel portion.

7. In a stringed musical instrument the combination comprising a body with upper and lower ends, and a neck extending upwardly from said upper end of said body, said neck being an assembly of parts including a main part having a forward surface and a curved rear surface and also having a groove extending longitudinally of said main part, an elongated stiffener received in said groove of said main part and fixed to said main part along substantially their entire common length, a fingerboard overlying said forward surface of said main part, said stiffener having a longitudinally extending recess therein, a tension rod received in said recess, both said stiffener and said tension rod having moduli of elasticity which are relatively high in comparison to that of said main neck part, said tension rod at one of its ends being bent to define an end post extending generally perpendicular to the remainder of said tension rod, and said stiffener at its corresponding end having an abutment surface engageable by said end post to limit movement of said tension rod relative to said stiffener in the direction toward its opposite end, and a nut threaded onto the other end of said tension rod and workable against the adjacent end of said stiffener to tension said tension rod between said end post and said nut, said stiffener including means engageable with said tension rod between said end post and said nut to hold said tension rod in a bowed condition and to thereby cause said stiffener to be bent by a variable amount between said stop means and said nut as the effective length of said tension rod is varied by adjustment of said nut.

* * * * *